US005165660A

United States Patent [19]

Engel et al.

[11] Patent Number: 5,165,660

[45] Date of Patent: Nov. 24, 1992

[54] DRIVE UNIT FOR A JACK

[75] Inventors: Darryl L. Engel, LaOtto; John R. Scoville, Butler, both of Ind.

[73] Assignee: Universal Tool & Stamping Co., Inc., Butler, Ind.

[21] Appl. No.: 746,885

[22] Filed: Aug. 19, 1991

[51] Int. Cl.[5] ..... B66F 3/08

[52] U.S. Cl. ..... 254/126; 403/301; 403/302; 254/DIG. 3

[58] Field of Search ..... 254/7 R, 98, 126, DIG. 3, 254/122; 81/121.1, 177.2; 403/301, 302, 309, 313

[56] References Cited

U.S. PATENT DOCUMENTS 1,267,151 5/1918 Wellman ..... 254/126
1,540,013 6/1925 Jenkins ..... 254/126
1,901,915 3/1933 Loughridge ..... 254/126
1,982,642 12/1934 Curok ..... 254/126
2,582,560 1/1952 Peterson et al. ..... 254/126
3,857,548 12/1974 Takeuchi ..... 254/126
4,583,713 4/1986 Fukura et al. ..... 254/126

*Primary Examiner*—J. J. Swann
*Attorney, Agent, or Firm*—Hill, Van Santen, Steadman & Simpson

[57] ABSTRACT

An improved drive unit for a jack mechanism which is formed from an inexpensive stamping and it can be attached to the control shaft of a jack by staking, welding or other matter and which can be bent into a shape which has an opening to receive a flatted handle for operating the jack and which also has manual extensions which can be used to manually lower and raise the jack.

1 Claim, 1 Drawing Sheet

DRIVE UNIT FOR A JACK

BACKGROUND OF THE INVENTION

1. Field of the Invention

This invention relates in general to a jack and in particular to a novel jack drive unit which can be formed from a stamping and which can be manually rotated by an operator.

2. Description of Related Art

A current means of driving a jack has used a forged drive unit which is driven by a wire crank handle having a flattened spoon end. Such forge drive unit is a costly item and such forged drive units cannot be readily rotated manually by the operator.

SUMMARY OF THE INVENTION

The present invention provides a stamping which can be staked, welded, bolted or otherwise attached to the drive member of any jack after which the stamping can be bent to bring the opposite ends together so as to provide a thumb and finger handle for manually turning the jack and also to provide an opening for receiving the end of a crank handle therein. The novel jack drive unit of the invention is inexpensive and easy to install and also provides a handle to allow the jack to be manually controlled.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

Figures 1, 2, 3, 4, 5, 6, 7:
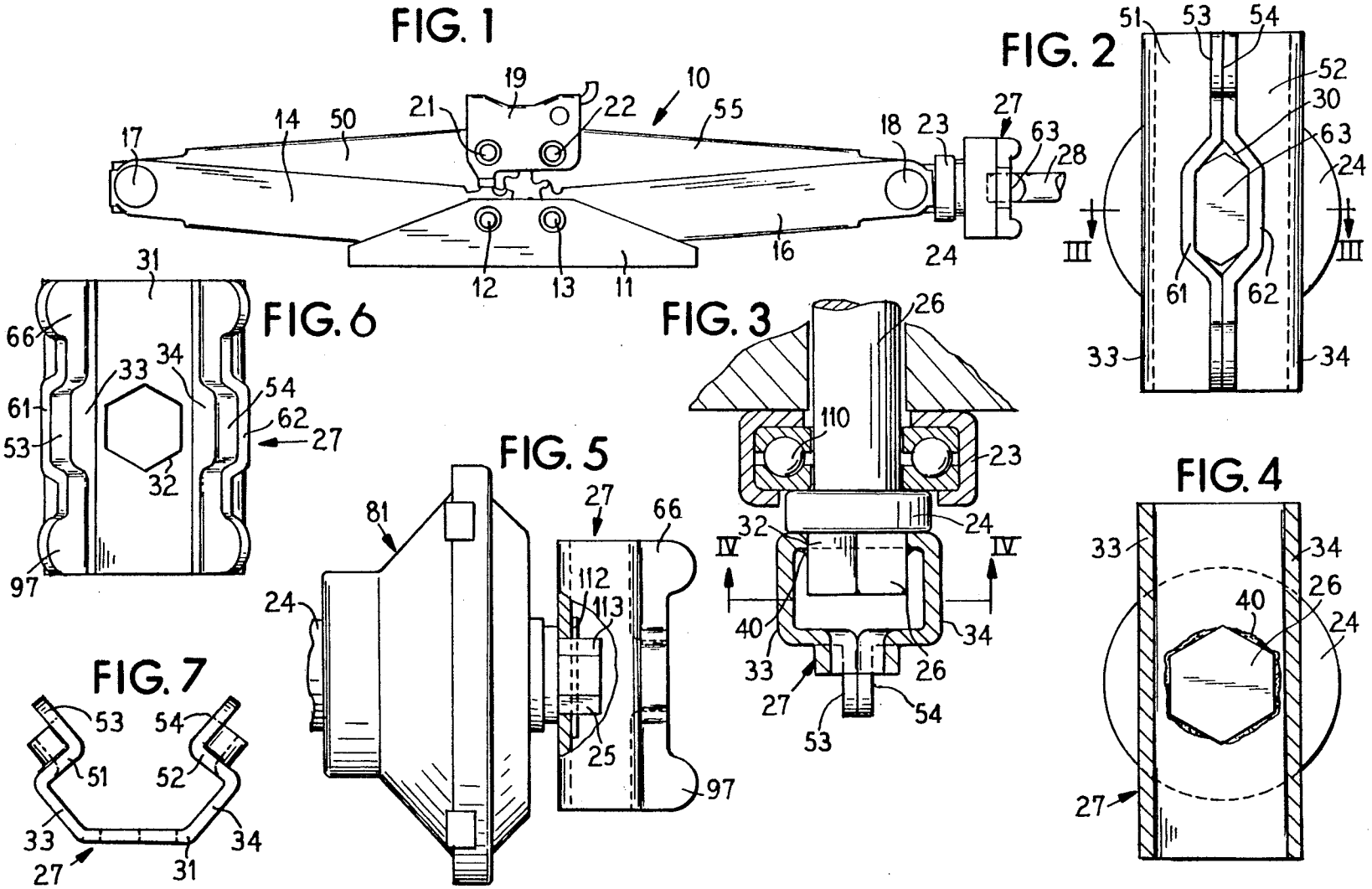
FIG. 1 is a side plan view of a jack with the invention installed therein.
FIG. 2 is an end view of the drive unit of the invention.
FIG. 3 is a sectional view taken on line III—III from FIG. 2.
FIG. 4 is a sectional view taken on line IV—IV from FIG. 3.
FIG. 5 illustrates the invention mounted on a modified jack structure.
FIG. 6 is a plan view of the invention before it is bent.
FIG. 7 is an end view of the invention illustrated in FIG. 6.

FIG. 1 illustrates the improved jack drive 27 installed on a scissors type jack 10. Although the invention is illustrated in combination with a scissors jack, it may be utilized with any type of jack which is controlled by rotating a shaft. The scissors jack 10 has a base 11 which carries pivot pins 12 and 13 for pivotally supporting the lower pivot arms 14 and 16. Pivot pins 17 and 18 connect the lower pivot arms 14 and 16 to upper pivot arms 50 and 55 which are pivotally connected by pivot pins 21 and 22 to a support 19. A collar 23 is attached to an end 24 of the control shaft 26 of the jack as illustrated in FIG. 3 and the shaft 26 terminates in a hexagonal end 26. The drive unit 27 of the invention is formed with an opening 30 for receiving the end 63 of a shaft 28 which is connected to a suitable handle not shown for rotating it to raise and lower the jack.

As shown in FIGS. 6 and 7, the drive unit 27 is formed from a stamping which has a flat rear portion 31 formed with a hexagonal opening 32 through which the head 26 of the jack extends. Upwardly extending sides 33 and 34 are attached to the bottom portion 31 as shown in FIG. 7 and inwardly extending portions 51 and 52 are connected to the portions 33 and 34 and outwardly extending portions 53 and 54 are connected to the portions 51 and 52 as shown in FIG. 7. The drive unit 27 is attached to the hexagonal head 26 by welding, staking or other suitable fashion and in FIGS. 3 and 4 the hexagonal head 26 is shown as welded by welds 40 to the member 27. After the member 27 has been connected to the hexagonal head 26, then the drive unit 27 is closed from the semi-opened position shown in FIGS. 6 and 7 by bending the sides 53 and 54 together so that they form the configuration illustrated in FIG. 2 wherein the sides 53 and 54 engage each other except at the center portions wherein sidewalls 61 and 62 are spaced apart to form an opening 30 for receiving the flatted end 63 of the jack handle 28. Above and below the portions 61 and 62 relative to FIGS. 2 and 5 are formed thumb extensions 66 and 97 so that the jack drive unit 27 can be manually rotated to raise and lower the jack.

FIG. 3 is a sectional view and illustrates the drive unit 27 in section taken on line III-III from FIG. 2 and illustrates bearings 110 mounted in the collar 23 for rotatably supporting the shaft 26.

FIG. 5 illustrates a modified form of the invention wherein the jack drive unit 27 is connected to a planetary gear drive 81 which connects to the shaft 24 of the jack. The member 27 is connected by pin 112 to the drive shaft 113 as shown in cut-away in FIG. 5.

It is seen that this invention provides a new and novel drive unit for a jack and although the invention has been described with repect to preferred embodiments, it is not to be so limited as changes and modifications can be made which are within the full intended scope of the invention as defined by the appended claims.

We claim as our invention:

1. A unit which is driven by a jack handle and which is attached to a jack which has an operating shaft which has an end portion formed with straight sides, comprising, a planar back portion formed with an opening that has straight sides through which said end portion of said operating shaft extends, means for attaching said planar back portion to said shaft, first and second upwardly extending sides which extend parallel to each other outwardly from said planar back portion and which are spaced a first distance apart and which have a dimension in a direction which is normal to said operating shaft which is greater than said first distance, first and second inwardly extending portions attached, respectively to said first and second upwardly extending sides, first and second outwardly extending portions attached to said first and second outwardly extending portions, said first and second outwardly extending portions in contact with each other, and an opening formed between said first and second outwardly extending portions into which said jack handle can be received.

* * * * *